United States Patent [19]

Phillips

[11] Patent Number: 5,060,998

[45] Date of Patent: Oct. 29, 1991

[54] SHOPPING AID

[76] Inventor: Pamela S. Phillips, 25842 County Rd. 6 East, Elkhart, Ind. 46514

[21] Appl. No.: 396,938

[22] Filed: Aug. 21, 1989

[51] Int. Cl.[5] ..... B65D 33/06

[52] U.S. Cl. ..... 294/146; 294/159; 294/170; 294/171

[58] Field of Search ..... 294/171, 137, 145, 146, 294/159, 162, 163, 165, 166, 168, 170; 16/110 R, 114; 383/13, 25

[56] References Cited

U.S. PATENT DOCUMENTS

| | | | |
|---|---|---|---|
| 424,806 | 4/1890 | Morris | 294/168 X |
| 2,454,908 | 11/1948 | Buxton | 294/168 X |
| 2,778,555 | 1/1957 | Poryle | 294/137 X |
| 3,083,366 | 3/1963 | Franges | 294/171 |
| 3,680,752 | 8/1972 | Wilson | 294/171 |
| 4,902,060 | 2/1990 | Nobakht | 294/171 |
| 4,923,235 | 5/1990 | Stewart | 294/171 X |

FOREIGN PATENT DOCUMENTS

| | | | |
|---|---|---|---|
| 1234567 | 6/1971 | United Kingdom | 383/13 |
| 2132882 | 7/1984 | United Kingdom | 294/171 |

*Primary Examiner*—Margaret A. Focarino
*Assistant Examiner*—Dean J. Kramer
*Attorney, Agent, or Firm*—Richard Bushnell

[57] ABSTRACT

A shopping aid for carrying bags, boxes and the like including a tubular member having a top section and a bottom section which meet at approximately mid-points of opposite sides of the tubular member and slots for receiving handles of bags.

11 Claims, 2 Drawing Sheets

SHOPPING AID

BACKGROUND OF THE INVENTION

The present invention relates to a shopping aid or carrier and more specifically to a novel handle used for carrying shopping bags, boxes, bundles or the like.

At the present time, many grocery stores or the like provide the shopper with plastic bags with handles for carrying groceries and other merchandise. The plastic bags are carried by the shopper by inserting the fingers through the handles. These handles tend to cut or dig into the user's fingers. This is especially true when the bags are heavily loaded or when the user carries multiple bags in one hand.

In addition, many department stores provide shopping bags with wire handles. When the shopper has many bags it can be difficult and cumbersome to carry the bags at the same time.

Heretofore, a shopper could use a portable shopping cart to carry their purchases home from grocery stores or department stores. These shopping carts are generally metal carts or the like on wheels. Although, these portable shopping carts are generally collapsible, they are heavy and cumbersome to carry when not in use.

Accordingly, a general object of the present invention is to provide a novel shopping aid or carrier that is lightweight and easy to use.

Another object of the present invention is to provide a novel shopping aid which is easy and economical to manufacture.

A more specific object of the present invention is to provide a handle which includes means to receive and retain handles of a plastic bag or shopping bag so that the shopper can easily carry heavily loaded bags or multiple bags.

SUMMARY OF THE INVENTION

A shopping aid or carrier for carrying bags or the like. The shopping aid includes a cylindrical member having a top semi-circular section and a bottom semi-circular section, and means located in portions of the top semi-circular section for receiving the handles of the bags.

BRIEF DESCRIPTION OF THE DRAWINGS

Features of the present invention which are believed to be novel are set forth with particularity in the appended claims. The organization and manner of operation of the invention, together with further objects and advantages thereof, may best be understood by reference to the following description taken in connection with the accompanying drawings in which:

DETAILED DESCRIPTION OF THE ILLUSTRATED EMBODIMENT

Figures 1, 2, 3, 4, 5, 6, 7, 8, 9, 10:
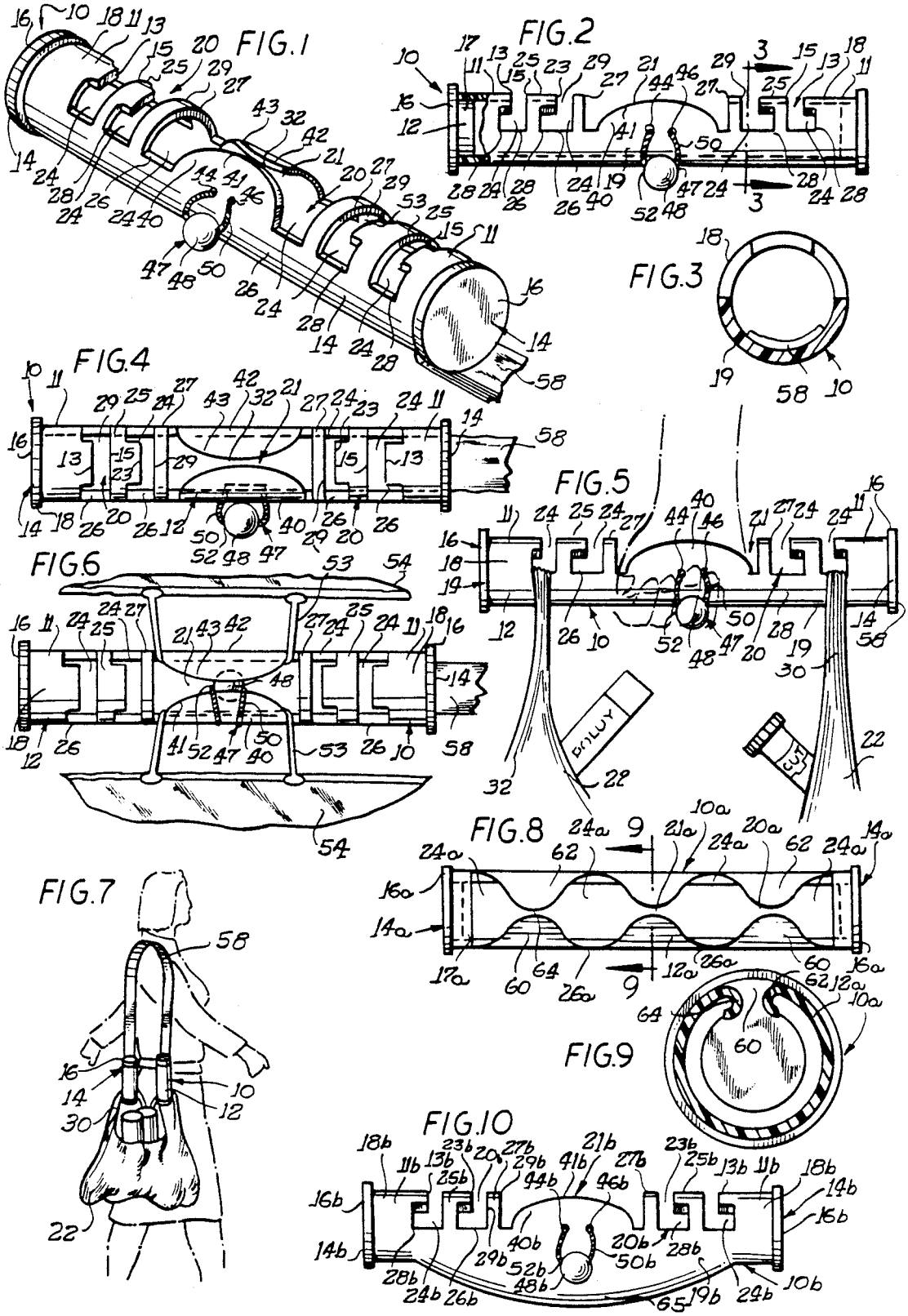
FIG. 1 is a perspective view showing one embodiment of the shopping aid or carrier incorporating features of the present invention.
FIG. 2 is a reduced side partially broken away elevational view of the shopping aid or carrier shown in FIG. 1.
FIG. 3 is an enlarged sectional view taken along line 3—3 of FIG. 2.
FIG. 4 is a reduced top plan view of FIG. 1.
FIG. 5 is a side elevational view showing one way a shopper can use the shopping aid.
FIG. 6 is a top plan view showing another way in which the shopper can use the shopping aid.
FIG. 7 is a view showing two shopping aids secured together by a strap that can be carried over the user's shoulder.
FIG. 8 is a top plan view of a second embodiment incorporating features of the present invention.
FIG. 9 is an enlarged sectional view taken along line 9—9 of FIG. 8.
FIG. 10 is a side elevational view of a third embodiment incorporating features of the present invention.

Turning to the drawings, wherein like components are designated by like reference numerals throughout the various figures, a shopping aid, constructed in accordance with the present invention is illustrated in FIGS. 1–7, and generally designated by reference numeral 10.

It is to be noted that the shopping aid 10, is preferably made of one-piece sheet or extruded material such as plastic or the like, which has been shaped by known methods into a tube, cylindrical member or handle 12 having opposite end potions 11.

As shown in FIGS. 1–7, the handle 12 is hollow and has opposite open ends. However, it is understood that the handle can be made by a variety of materials such as wood, metal, plastic or the like and can be solid rather than hollow.

An end cap 14 is releasably secured to each open-end of the handle 12. As shown best in FIG. 2, the end cap 14 includes a substantially circular base portion 16 having an outwardly extending circular flange or stub shaft portion 17 which extends therefrom and into the hollow cylindrical member 12. The outer diameter of flange portion 17 is slightly less than the inner diameter of the cylindrical member 12. In addition, the circumference of the base portion 16 is substantially greater than the outer circumference of the handle 12. Thus, as shown best in FIG. 2, the flange portion 17 of end cap 14 fits snuggly in the inside of the handle 12 for frictional engagement therewith. The inside portion of the base member 16 is flush against the outer end of the handle 12.

The handle 12 includes a substantially semi-circular upper or top portion or section 18 and a substantially semi-circular bottom or lower portion or section 19. It is to be noted that upper section 18 and lower section 19 meet at substantially the mid-point of opposite sides of cylindrical member 12.

As shown in FIGS. 1, 2, 4, 5 and 6, the upper or top semi-circular section 18 of the cylindrical member 12 includes first receiving means 20 for receiving the handles 30 of plastic bag 22 or the like.

First receiving means 20 includes first and second spaced apart slots 24 positioned substantially adjacent opposite ends of the cylindrical member 12. Slots 24 extend laterally through predetermined portions of the top section 18 so that one end of slot 24 begins at approximately the mid-point or a predetermined point of one side of cylindrical member 12 and ends at approximately the same point at the opposite side of cylindrical member 12. Thus constructed, the predetermined beginning and terminal ends of slot 24 defines a stop member 26 locatable in the sidewalls of the cylindrical member. The stop member 26 will be discussed below.

As previously set forth, first and second slots 24 extend through a portion of top section 18 of cylindrical member. Thus, first slot 24 is defined by a free edge 13 of end portion 11 and an opposed free edge 15 of a mid-portion 25 of top section 18. Second slot 24 is defined by an opposite free edge 23 of mid-portion 25 and an edge 29 of an inner portion 27 of top section 18. As shown best in FIG. 5, a retaining means or notch 28 is provided at each end of slot 24 adjacent stop members 26 for releasably retaining the handle 30 of bag 32. The notch 28 extends into a portion of opposite sides of said cylindrical member 12 so that the edge 13 has a hook shaped configuration. As shown in FIG. 5, when the handle 30 of bag 22 is placed in a slot 24, the handle 30 rests on stop portion 26 and is secured by notch 28.

The cylindrical member 12 also includes second receiving means 21 for receiving handles 53 of shopping bags 54 or the like. Second receiving means 21 includes a substantially longitudinally extending slit 32 centrally disposed in the top section 18 of handle 12. The slit 32 is defined by free edges 41 and 43 of spaced apart first and second sidewall portions or sections 40 and 42, respectively. Sidewall portions 40 and 42 have terminal ends for receiving handles of bags. As shown best in FIG. 6, the handles 53 of bags 54 may be wrapped around sidewall portions 40 and 42.

Sidewall portion 40 is also provided with means 47 for retaining handles 53 of bag 54. Means 47 include a pair of spaced apart apertures 44 and 46 in sidewall portion 40. A bead or retaining member 48 is secured to the sidewall 40 by a rubber band or elastic cord 50. The cord 50 extends through an aperture 52 positioned through the middle of bead 48. The free ends of cord 50 are threaded through apertures 44 and 46 in sidewall portion 40. The free ends of cord 50 are secured together by suitable means not shown.

It is to be noted that first and second receiving means of cylindrical member 12 can receive and retain handles from a variety of types of bundles, boxes or bags.

As shown best in FIG. 6, after the handles 53 of shopping bag 54 are positioned over sidewall portions 40 and 42, the bead 48 can be manuevered or stretched with the user's thumb so that the bead 48 extends around sidewall portion 40 and is then pushed under slit 32. The circumference of bead 48 is substantially greater than the width of slit 32 so that bead 48 retains bag handle 53 of bag 54.

As shown best in FIG. 7, a pair of handles 12 can be connected by strap member 58. The strap 58 is preferably made of some type of cloth or other pliable material and can be inserted through an open end of handle 12 and pushed through to the opposite end of handle 12 and retained by cap member 14 at each end thereof. The user can carry the shopping aid over their shoulder as shown in FIG. 7 or around the user's neck. In addition, the strap 58 can be used to secure both handles 12 together when the handles are not in use or are being stored.

FIGS. 8 and 9 show a second embodiment of this invention in which elements corresponding to the above-identified elements are designated with the same reference numeral with a suffix "a". As shown in FIG. 8, the shopping aid **10*a* includes a substantially cylindrical open-ended handle 12*a* having caps 14*a* inserted at either end. Shopping aid 10*a* is preferably made of a one-piece plastic or metal material having a plurality of scalloped free ends 60 and 62 and is molded in a known manner into handle 12*a*. The handle 12*a* includes receiving means comprising a plurality of slots 64 defined by spaced apart free ends 60 and 62 of scallops in handle 12*a*. The handles of bags can be inserted in the slots 64 into the transverse slots or openings between the point or ends 60 and 62 of the scallop in much thee same manner as shown in FIG. 5**.

FIG. 10 shows a third embodiment of this invention in which elements corresponding to the above-identified elements are designated with the same reference numeral with the suffix "b".

As shown in FIG. 10, the shopping aid **10*b* includes first and second means 20*b* and 21*b* respectively for receiving handles of bags. The lower semi-circular section 19*b* of handle 12*b* includes a substantially rounded or convex protrusion 65. The convex protrusion 65** is designed to fit or mold into the palm of the user's hand. This enables the user to easily carry heavier loads because the weight of the bag is more evenly distributed.

Figures 11, 12, 13, 14, 15, 16, 17, 18:
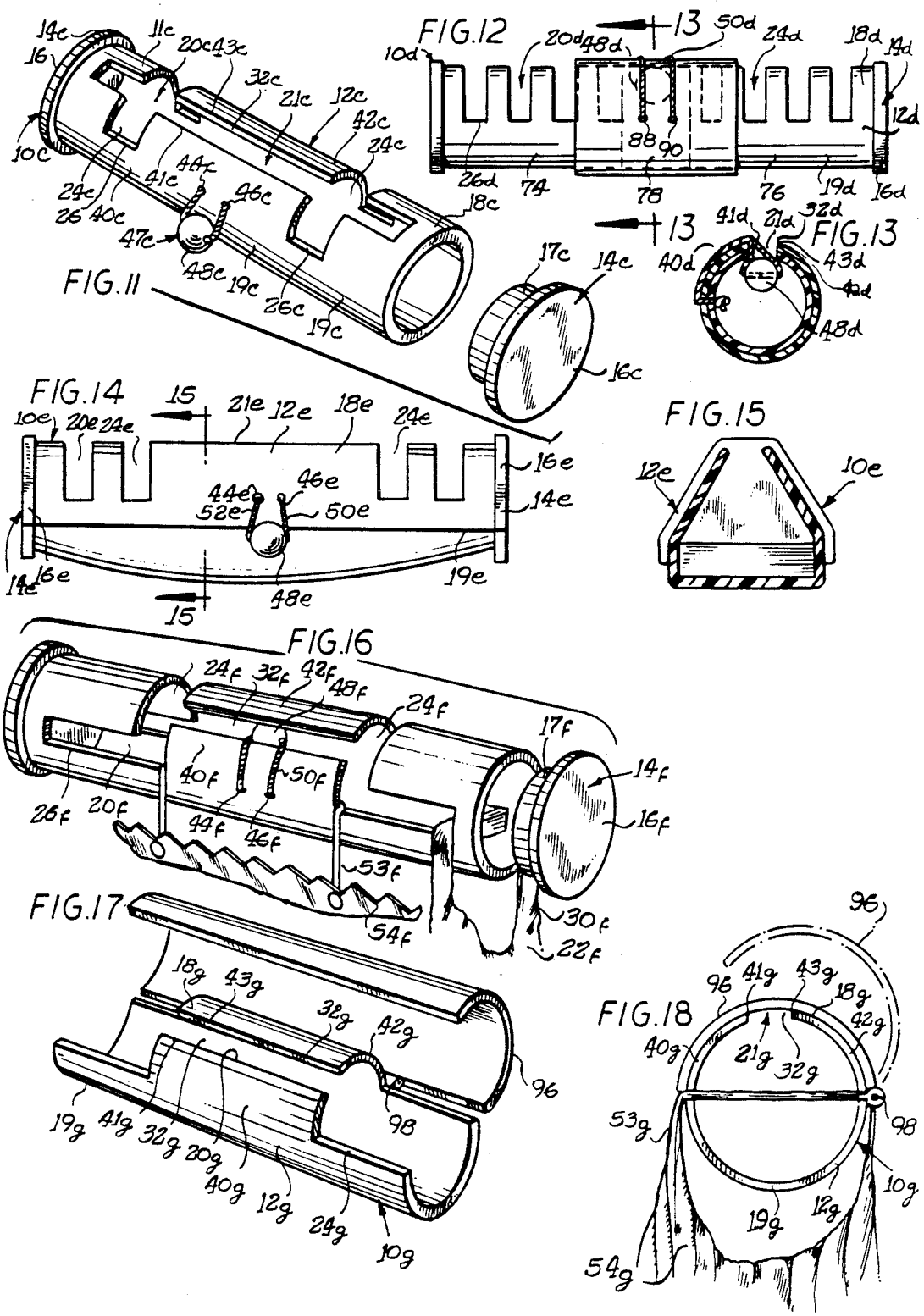
FIG. 11 is an exploded perspective view of a fourth embodiment incorporating features of the present invention.
FIG. 12 is a side elevational view of a fifth embodiment incorporating the features of the present invention.
FIG. 13 is an enlarged sectional view taken along line 13—13 of FIG. 12.
FIG. 14 is a side elevational view of a sixth embodiment incorporating the features of the present invention.
FIG. 15 is a sectional view taken along line 15—15 of FIG. 14.
FIG. 16 is an exploded perspective view of a seventh embodiment incorporating features of the present invention.
FIG. 17 is a fragmentary view of an eighth embodiment incorporating features of the present invention.
FIG. 18 is a sectional view along line 18—18 of FIG. 17 and further showing a bag hanging from the aid or carrier device, a cover in a closed solid line position and an open broken line position.

FIG. 11 shows yet another embodiment of this invention in which elements corresponding to the above-identified elements are designated with the same reference numeral with the suffix "c". The shopping aid **10*c* shown in FIG. 11 includes a handle 12*c* having an upper semi-circular section 18*c* and a lower semi-circular section 19*c*. The upper semi-circular section 18*c* includes first and second bag receiving means 20*c* and 21*c* respectively. Like the embodiments of the shopping and identified above, shopping aid 10*c* is preferably made of a one-piece sheet of plastic or metal material or the like which is formed in a known manner into a tube 12*c***.

The handle **12*c* includes a first sidewall portion 40*c* and a second sidewall portion 42*c*** having terminal end portions for receiving handles of bags.

Free edges **41*c* and 43*c* of sidewall portions 40*c* and 42*c* define bag receiving means 32*c* which has been described in detail above. Further, as discussed above, the handles of a bag can be placed around sidewalls 40*c* and 42*c* and retained by retaining means 47*c*. In addition, handles of a bag can also be placed in slots 24*c***.

FIGS. 12 and 13 show yet another embodiment of this invention in which elements corresponding to the above-identified elements are designated with the same reference numeral with the suffix "d". The shopping aid **10*d* shown in FIGS. 12 and 13 includes a handle 12*d* having a substantially semi-circular upper section 18*d* and a substantially semi-circular lower section 19*d*. The upper semi-circular section includes first receiving means 20***d* for receiving the handles 30*d* of bags 22*d* or the like. First receiving means 20*d* include a plurality of spaced apart slots 24*d* for receiving and retaining handles of bags.

The handle 12*d* also includes first and second sections or halves 74 and 76 respectively of substantially equal length as shown in FIG. 12. First section 74 and second section 76 are telescopically joined by split sleeve 78 shown in FIG. 12. Sleeve 78 overlaps adjacent ends of first section 74 and second section 76. Thus constructed, the size or length of handle 12*d* can be reduced when not in use to facilitate easy storing or carrying in the user's purse or bag.

As shown in FIG. 13, the split sleeve 78 has free ends 40*d* and 42*d* having edges 41*d* and 43*d* respectively which define second bag receiving means 21*d* or slot 32*d* for receiving handles of bags or the like.

Sleeve member 78 includes adjacent apertures 88 and 90 positioned on one side thereof for receiving a cord 50*d* and bead 48*d* as discussed above. Thus constructed, handles of shopping bag can be inserted into receiving means 21*d* and retained by bead 48*d*.

FIGS. 14 and 15 show yet another embodiment of this invention in which elements corresponding to the above-identified elements are designated with the same reference numeral with the suffix "e". The shopping aid 10*e* includes a handle 12*e* having first and second receiving means 20*e* and 21*e* respectively for receiving handles of bags or the like.

The lower section 19*e* of the handle 12*e* is substantially rounded or curved which will allow for easier handling. The embodiment further illustrates how the cross-section in configuration of the tubular handle while being generally characterized as cylindrical or circular, can be polygonal.

FIG. 16 illustrates another embodiment of this invention in which elements corresponding to the above-identified elements are designated with the same reference numeral with the suffix "f". The handle 12*f* includes first and second means 20*f* and 21*f* for receiving handles of bags or the like. Receiving means 20*f* comprises slots 24*f* positioned substantially adjacent opposite ends of handle 12*f*. A substantially horizontal elongated notch 94 extends from one side of each slot 24*f* towards corresponding ends of handle 12*f*. Thus, constructed, the handles 30*f* of bags 22*f* are securely retained in slot 24*f*.

FIGS. 17 and 18 reveal still another embodiment of this invention in which elements corresponding to the above-identified corresponding elements are designated with the same reference numeral with the suffix "g".

The shopping aid 10*g* includes a handle 12*g* having first and second bag receiving means 20*g* and 21*g*. Since only a portion of the handle 12*g* is shown, the first receiving means 20*g* which may be the same as any of the above described means 20*g* which are not fully shown in this illustration. The second receiving means 21*g* includes a longitudinal slot 32*g* defined by free edges 41*g* and 43*g* of sidewall sections 40*g* and 42*g*. Sidewall sections 40*g* and 42*g* have terminal ends for receiving handles of bags.

As shown in FIG. 18, the handles 53*g* of bags 54*g* can be inserted crosswise at opposite ends of sidewall sections 40*g* and 42*g*. Alternatively, bag handles may be inserted into the receiving means 21*g*.

The handle 12*g* also includes a substantially semi-circular cover 96 secured to handle 12*g* by hinge means 98 as shown in FIGS. 17 and 18. When the handle 53*g* of bag 54*g* are positioned around sidewall section 40*g*, the cover 96 is closed thereby securing the handles 53*g* in the shopping aid 10*g*.

While particular embodiments of the present invention have been shown and described in detail, it will be obvious to those skilled in the art that changes and modifications of the present invention may be made without departing from the invention in its broader aspects.

The invention is claimed as follows:

1. An aid for carrying bags or the like, said aid comprising a tubular member having a top section and a bottom section said top and bottom sections meeting at approximately the mid-point of opposite sides of said tubular member, and means in said top section for receiving handles of said bags, said means for receiving handles of said bags including first and second means in said top section for receiving handles of said bags, said first bag handle receiving means having at least one slot means extending substantially transversely through a portion of said top section, said slot means beginning at a predetermined point of one side of said tubular member and terminating at said opposite side of said tubular member, and said second bag handle receiving means providing a longitudinally extending slit defined by free edges of first and second sidewall sections, said first and second, sidewall sections having terminal ends for receiving handles of said bags, one of said sidewall sections including means for releasably retaining the handles of said bags, said bag retaining means including a bead having an elastic cord connection thereto, said core extending through adjacent aperture means in one of said sidewall sections and being secured thereto.

2. An aid of claim 1, wherein said slot means includes means for releasably retaining said handles of said bags.

3. An aid of claim 2 wherein said handle retaining means includes first and second notches locatable at each end of said slot means, said first notch extending into a portion of one side of said cylindrical member adjacent one end of said slot means and said second notch extending into a portion of an opposite side of said cylindrical member adjacent an opposite end of said slot means.

4. An aid of claim 1, wherein said tubular member is hollow and open ended, said aid further including cap members having a base portion and circular portion which extends therefrom and into an open end of said tubular member for frictional engagement therewith.

5. An aid of claim 4, which includes a pair of said tubular members, and means for joining said pair of tubular members together, said joining means being retained in each of said tubular members by said caps.

6. A shopping aid for carrying bags or the like comprising cylindrical means having a top semi-circular portion and a bottom semi-circular portion and first and second means locatable in said top semi-circular portion for receiving handles of said bags, said first bag handle receiving means including slot means extending transversely through a section of said top semi-circular portion, said slot being at a predetermined point at one side of said cylindrical means and terminating at another point at an opposite side of said cylindrical means, said second bag handle receiving means including first and second sidewall sections in said cylindrical means, said first and second sidewall sections having free edges defining a slit for receiving handles of said bag, said cylindrical means having first and second open-ended hollow cylindrical members, each of said first and second cylindrical members having means for receiving handles of said bags, and an outer hollow cylindrical sleeve member overlapping and slidably telescopically receiving adjacent ends of said first and second cylindrical members, said sleeve member having means for receiving handles of said bags.

7. A shopping aid of claim 6, wherein said receiving means in said first and second cylindrical members includes at least one slot extending substantially transversely through a portion of each said cylindrical member.

8. A shopping aid of claim 6, wherein said receiving means of said sleeve member includes a longitudinally extending slit which extends from one end of said sleeve member to an opposite end of said sleeve member, said slit being defined by spaced apart free edges of said sleeve member.

9. A shopping aid of claim 6, wherein said sleeve member includes means for releasably retaining said handles of said bags, said releasable means includes a bead having an elastic cord member attached thereto, said elastic cord member being secured to one side of said sleeve member.

10. A shopping aid of claim 6, which includes cap members having a base portion and a protrusion which extends therefrom respectively into an open-end of said cylindrical members for frictional engagement therewith.

11. An aid for carrying bags or the like, said aid comprising a hollow open-ended tubular member having a top section and a bottom section, said top and bottom section meeting at approximately the mid-point of opposite sides of said tubular member, and means in said top section for receiving handles of said bags, said tubular member including means for releasably retaining the handles of said bags, said bag handle retaining means including a bead having a cord connected thereto, said cord extending through adjacent aperture means in said tubular member and being secured thereto, said tubular member including cap members having a base portion and circular portion which extends therefrom and into an open end of said tubular member for frictional engagement therewith, said aid having means for joining a pair of tubular members together, said joining means being retained in each of said tubular members by said caps.

* * * * *